US007243714B2

(12) United States Patent
Van Den Dobbelsteen

(10) Patent No.: US 7,243,714 B2
(45) Date of Patent: Jul. 17, 2007

(54) WELL PROVIDED WITH FLEXIBLE PRODUCTION TUBING

(75) Inventor: Willem Van Den Dobbelsteen, Assen (NL)

(73) Assignee: Shell Oil Company, Houston, TX (US)

( * ) Notice: Subject to any disclaimer, the term of this patent is extended or adjusted under 35 U.S.C. 154(b) by 175 days.

(21) Appl. No.: 10/476,466

(22) PCT Filed: Apr. 26, 2002

(86) PCT No.: PCT/EP02/04853

§ 371 (c)(1),
(2), (4) Date: Oct. 31, 2003

(87) PCT Pub. No.: WO02/088521

PCT Pub. Date: Nov. 7, 2002

(65) Prior Publication Data

US 2004/0149453 A1 Aug. 5, 2004

(30) Foreign Application Priority Data

May 2, 2001 (EP) ..... 01304022

(51) Int. Cl.
*E21B 29/00* (2006.01)

(52) U.S. Cl. ..... 166/207; 166/242.1; 166/187; 138/118; 138/153; 138/174

(58) Field of Classification Search ..... 166/207, 166/242.1, 187; 138/118, 153, 172, 174
See application file for complete search history.

(56) References Cited

U.S. PATENT DOCUMENTS

| | | | | |
|---|---|---|---|---|
| 57,233 | A * | 8/1866 | White et al. | 138/174 |
| 3,217,282 | A | 11/1965 | Chevalier et al. | |
| 3,515,172 | A * | 6/1970 | Hahn, Jr. | 138/118 |
| 3,675,720 | A * | 7/1972 | Sizer | 166/115 |
| 4,336,415 | A | 6/1982 | Walling | |
| 4,374,530 | A | 2/1983 | Walling | |
| 4,467,836 | A | 8/1984 | Ragout | 138/93 |
| 4,895,185 | A * | 1/1990 | Champleboux et al. | 138/174 |
| 5,040,606 | A | 8/1991 | Hopper | |
| 5,209,136 | A | 5/1993 | Williams | |
| 5,327,963 | A | 7/1994 | Vance, Sr. et al. | |
| 5,576,485 | A * | 11/1996 | Serata | 166/207 |
| 5,813,459 | A * | 9/1998 | Carisella | 166/187 |
| 6,148,866 | A | 11/2000 | Quigley et al. | |
| 6,761,222 | B2 * | 7/2004 | Wilson | 166/187 |

OTHER PUBLICATIONS

Search Report dated Mar. 19, 1998.
International Search Report dated Aug. 8, 2002.

* cited by examiner

*Primary Examiner*—David Bagnell
*Assistant Examiner*—Matthew J. Smith
(74) *Attorney, Agent, or Firm*—Rachael A. Stiegel

(57) ABSTRACT

A well having a bore hole extending from surface to an underground formation, a casing arranged in the borehole, a tubing hanger supported on the top of the casing, a packer arranged in the casing at a predetermined depth, and a tubing extending from the tubing hanger to the packer, wherein the tubing includes a tubing section that consists of a tubular body of elastomeric material that is reinforced by axially extending reinforcement strands arranged in the tubular body.

6 Claims, 2 Drawing Sheets

FIG. 1
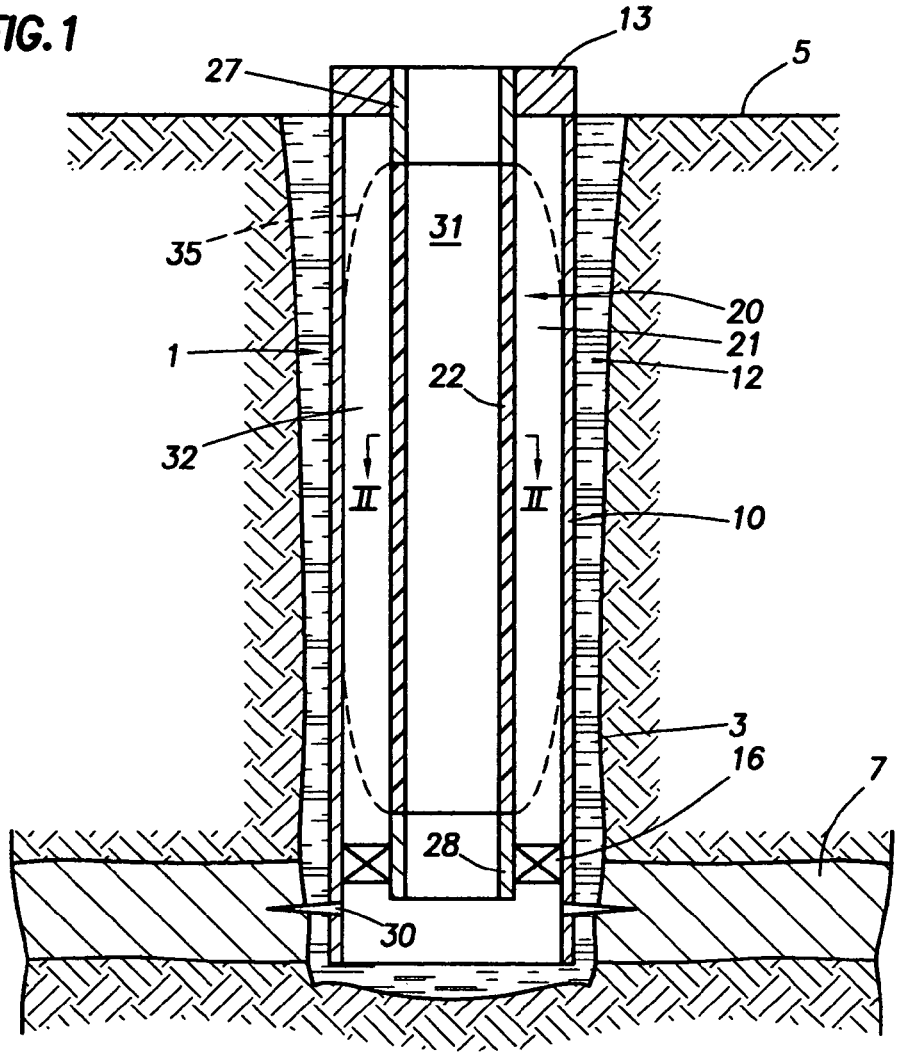
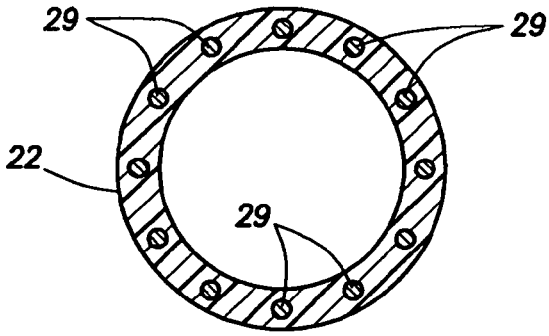
FIG. 2

WELL PROVIDED WITH FLEXIBLE PRODUCTION TUBING

PRIORITY CLAIM

The present application claims priority on European Patent Application 01304022.5 filed on 2 May 2001.

FIELD OF THE INVENTION

The present invention relates to the production of fluids, for example hydrocarbons from an underground formation from which the fluids are to be withdrawn. In order to produce fluids from an underground formation, a well is used.

BACKGROUND OF THE INVENTION

A well comprising a bore hole extending from surface to the underground formation, a casing arranged in the borehole, a tubing hanger supported at or near the top of the casing, a packer arranged in the casing at a predetermined depth, and a tubing extending from the tubing hanger to the packer. The well can be used for producing fluids from the formation. However, the well can also be use to inject fluids through the tubing into the formation, for example to enhance production.

The casing can be a single string or a set of strings one arranged inside the other, and the casing is normally fixed in the borehole by means of a layer of cement in the annulus between casing and wall of the borehole.

The invention relates in particular to the tubing through which the fluids will flow during normal operation. Normally the tubing is a steel pipe that extends from the tubing hanger to the packer.

The tubing has to fit in the casing through which the tubing extends, and this requirement limits the cross-sectional area that is available for fluid flow. Thus the throughput is restricted. In order to increase the throughput of an existing well, it is considered to remove the tubing so that the fluids flow through the casing. However, with no tubing well, control is nearly impossible. Moreover, when the fluids are aggressive, the casing can be affected.

SUMMARY OF THE INVENTION

To this end the well according to the present invention comprises a bore hole extending from surface to an underground formation, a casing arranged in the borehole, a tubing hanger supported at or near the top of the casing, a packer arranged in the casing at a predetermined depth, and a tubing extending from the tubing hanger to the packer, wherein the tubing includes a tubing section that consists of a tubular body of elastomeric material that is reinforced by axially extending reinforcement strands arranged in the tubular body.

During normal operation there is a pressure difference between the interior of the tubing and the annulus between tubing and casing. The properties of the reinforced tubular body have to be so selected that under this pressure difference the tubular body does not fail and is expanded such that its outer surface is in contact with the inner surface of the casing.

Reference is made to U.S. Pat. No. 4,374,530. This publication discloses a flexible tubing that is used to hang down a submersible hydraulic pump in a well, to drive the pump and to transport the produced fluids to surface. The known flexible tubing comprises a core of a polymer in which a production conduit and two hydraulic conduits are arranged. The conduits are either made of a polymer or of steel. In addition the core can contain strands embedded in the core to provide axial strength. This publication is not relevant to the present invention because the flexible tubing is so designed that it can be wound on a reel for easy application. This flexible tubing retains its outer diameter under operating conditions.

BRIEF DESCRIPTION OF THE DRAWING

The invention will now be described by way of example in more detail with reference to the accompanying drawings, wherein FIG. 1 shows schematically a sectional view of the well according to the present invention, drawn not to scale;

FIG. 2 shows schematically a section of FIG. 1 along II—II.

DETAILED DESCRIPTION OF THE PREFERRED EMBODIMENT

Figure 3:
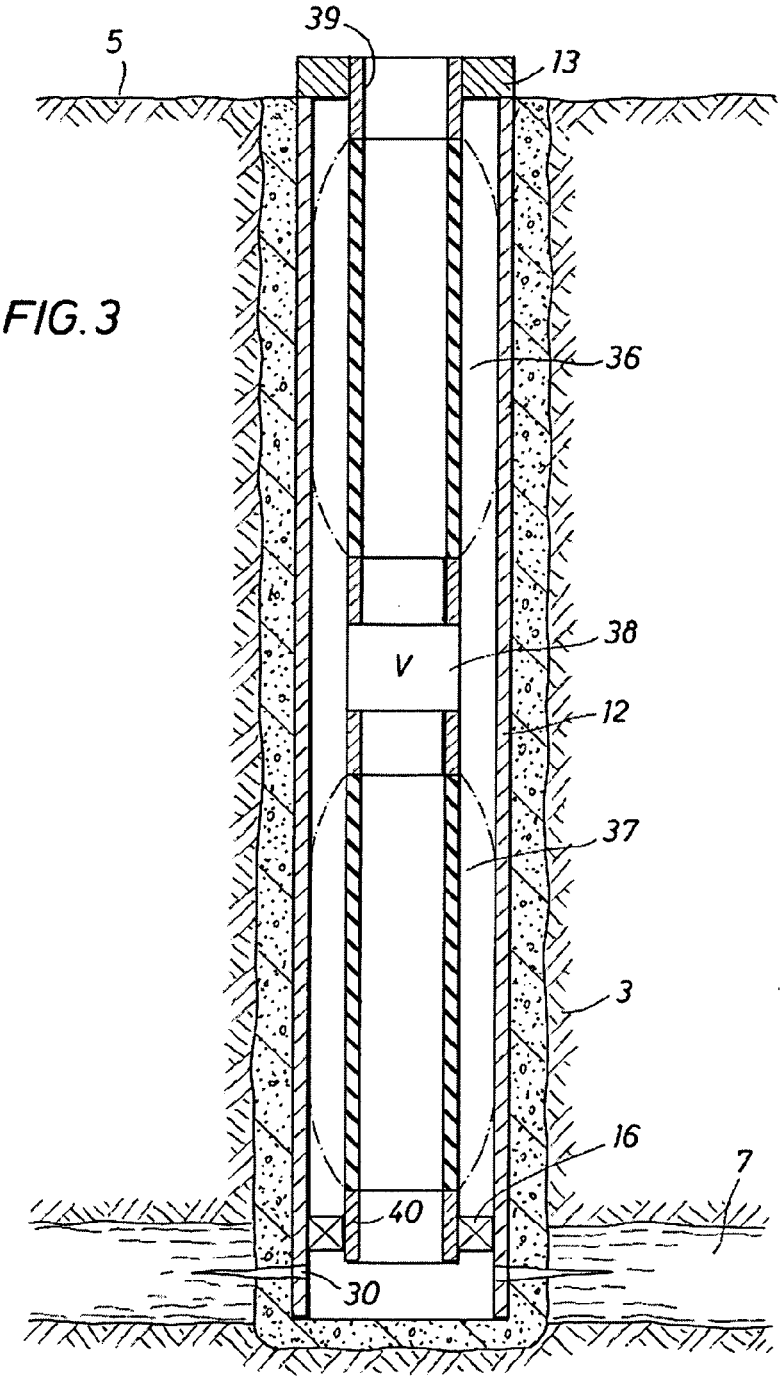
FIG. 3 shows schematically a sectional view of one embodiment of the invention in which two tubing sections are employed.

Reference is now made to FIG. 1, showing the well 1 according to the present invention. The well 1 comprises a borehole 3 extending through into the earth from surface 5 to an underground formation 7.

The borehole 3 is provided with a casing 10 arranged in it. The annulus between the wall of the borehole 3 and the casing 10 is filled with cement 12. The top of the casing 10 supports a tubing hanger 13. In the casing 10 there is arranged a packer 16 at a predetermined depth, which is in this case directly above the underground formation 7 to which the bore hole 3 extends.

The well 1 furthermore comprises a tubing 20 extending from the tubing hanger 13 to the packer 16. The tubing 20 includes a tubing section 21 that consists of a tubular body 22 of elastomeric material that is reinforced by axially extending reinforcement strands (not shown in FIG. 1) arranged in the tubular body 22.

The tubing 20 further includes tubular end parts 27 and 28 made of steel for securing the tubing section 21 to the tubing hanger 13 and in the packer 16.

The cross-section of the tubing section 21 is shown in more detail in FIG. 2. The tubular body 22 is reinforced with axially extending reinforcement strands 29 arranged in the body 22.

Reference is now made to FIG. 1. In order to allow fluid flow out of the underground formation 7, perforations 30 are made through the casing 10 and the cement 12 into the formation 7.

During normal operation fluids are allowed to flow out of the underground formation 7 into the tubing 20 and through the interior 31 of the tubing to a well head (not shown) at surface 5, which well head is located on the tubing hanger 13. The tubing hanger 13 is provided with means that allow controlling the pressure of liquid in the annulus 32 between the tubing 20 and the casing 10. In this way the pressure difference between the interior 31 of the tubing and the annulus 32 can be controlled.

The tubular body 22 is made of a suitable elastomer, and the properties of the reinforced tubular body 22 are so selected that under a pressure difference prevailing under normal operating conditions the tubular body 22 does not fail and is expanded such that its outer surface is in contact with the inner surface of the casing 10. The properties include the material properties of the elastomer and the dimensions of the tubular body 22 and the design of the reinforcement. Dashed line 35 shows the shape of the inflated tubular section 21. The number of reinforcement strands 29 is determined by the load-bearing capacity of the strands and the axial force to which the tubing 20 is subjected.

Optionally the tubular body consists of two or more interconnected layers.

The tubing 20 shown in FIG. 1 consists of a single tubing section 21. Alternatively the tubing consists of two tubing sections (upper tubing section 36 and lower tubing section 37 between which a safety valve 38 is arranged. In this case, each tubing section consists of a tubular body of elastomeric material that is arranged in the tubular body, of the upper tubing section is provided with tubular end parts 40 made of steel for securing the tubing section to the tubing hanger and to the safety valve and the tubular body of the lower tubing section is provided with tubular end parts 40 made of steel for securing the tubing section to the safety valve in the packer.

Suitably, the lower end of the tubing is provided with weighting elements (not shown), such as drill collars.

The end parts can be secured to the tubing section by any suitable means in such a way that the axial load is transferred from an end part to the axially extending strands in the tubular body. For example the ends of the strands can be fixed in holes extending axially through the end parts.

A covering layer can protect the inner and outer surfaces of the tubular body.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

I claim:

1. A well comprising a bore hole extending from surface to an underground formation, a casing arranged in the borehole, a tubing hanger supported at or near the top of the casing, a packer arranged in the casing at a predetermined depth, and a tubing extending from the tubing hanger to the packer, wherein the tubing includes a tubing section that consists of a tubular body of elastomeric material that is reinforced by axially extending reinforcement strands arranged in the tubular body.

2. A well according to claim 1, wherein the tubing consists of a tubing section that consists of a tubular body of elastomeric material that is reinforced by axially extending reinforcement strands arranged in the tubular body, which tubing section is provided with tubular end parts made of steel for securing the tubing section to the tubing hanger and in the packer.

3. A well according claim 2, wherein the lower end of the tubing is provided with weighting elements selected from sinker bars or drill collars.

4. A well according to claim 1, wherein the tubing consists of two tubing sections between which a safety valve is arranged, wherein each tubing section consists of a tubular body of elastomeric material that is reinforced by axially extending reinforcement strands arranged in the tubular body, wherein the tubular body of the upper tubing section is provided with tubular end parts made of steel for securing the tubing section to the tubing hanger and to the safety valve, and wherein the tubular body of the lower tubing section is provided with tubular end parts made of steel for securing the tubing section to the safety valve and in the packer.

5. The well according to claim 4, wherein the lower end of the tubing is provided with weighting selected from sinker bars or drill collars.

6. A well according claim 1, wherein the lower end of the tubing is provided with weighting elements selected from sinker bars or drill collars.

* * * * *